US010215461B2

(12) United States Patent
Hosokawa

(10) Patent No.: US 10,215,461 B2
(45) Date of Patent: Feb. 26, 2019

(54) ACCUMULATOR

(71) Applicant: FUJIKOKI CORPORATION, Setagaya-ku, Tokyo (JP)

(72) Inventor: Kouji Hosokawa, Tokyo (JP)

(73) Assignee: FUJIKOKI CORPORATION, Setagaya-Ku, Tokyo (JP)

( * ) Notice: Subject to any disclaimer, the term of this patent is extended or adjusted under 35 U.S.C. 154(b) by 0 days.

(21) Appl. No.: 15/210,232

(22) Filed: Jul. 14, 2016

(65) Prior Publication Data

US 2017/0016658 A1 Jan. 19, 2017

(30) Foreign Application Priority Data

Jul. 17, 2015 (JP) ..... 2015-143242

(51) Int. Cl.
*F25B 43/00* (2006.01)

(52) U.S. Cl.
CPC ..... *F25B 43/006* (2013.01); *F25B 43/00* (2013.01); *F25B 43/003* (2013.01); *F25B 2400/03* (2013.01); *F25B 2500/12* (2013.01)

(58) Field of Classification Search
CPC .... F25B 43/00; F25B 43/003; F25B 2400/03; F25B 2500/12
See application file for complete search history.

(56) References Cited

U.S. PATENT DOCUMENTS 3,837,177 A * 9/1974 Rockwell ..... F25B 43/006 62/503
4,111,005 A * 9/1978 Livesay ..... F25B 43/006 55/463
4,187,695 A * 2/1980 Schumacher ..... F25B 41/00 62/116
4,199,960 A * 4/1980 Adams ..... F25B 43/006 55/463
4,276,756 A * 7/1981 Livesay ..... F25B 43/003 62/298

(Continued)

FOREIGN PATENT DOCUMENTS

JP 11-278045 A 10/1999
JP 2001-248923 A 9/2001

(Continued)

OTHER PUBLICATIONS

Extended Search Report in corresponding European Application No. 16177880.8, dated Dec. 9, 2016, 4 pages.

*Primary Examiner* — Kun Kai Ma
(74) *Attorney, Agent, or Firm* — Brinks Gilson & Lione

(57) ABSTRACT

Provided is an accumulator capable of effectively suppressing a bumping phenomenon and the following impact noise during the starting of a compressor without making the structure of the accumulator complicated or increasing the cost and the size thereof, and so having cost-effectiveness. An accumulator includes: a tank 10 having an inflow port 15 and an outflow port 16; and a double-pipe structured outflow pipe 30 including an inner pipe 31 joined to the outflow port 16 and hanging inside of the tank 10, and an outer pipe 32 disposed outside of the inner pipe 31. A cloth-like member such as felt or a foam material 60 is wound around or externally inserted to the outer pipe 32.

5 Claims, 6 Drawing Sheets

(56) References Cited

U.S. PATENT DOCUMENTS 4,354,362 A * 10/1982 Schumacher ..... B01D 15/00 210/DIG. 6
4,651,540 A * 3/1987 Morse ..... F25B 43/006 55/441
4,768,355 A * 9/1988 Breuhan ..... F25B 43/006 261/DIG. 6
4,827,725 A * 5/1989 Morse ..... F25B 43/006 62/503
5,179,780 A * 1/1993 Wintersteen ..... F25B 43/003 29/422
5,580,451 A * 12/1996 Tack ..... B01D 15/00 210/266
6,148,632 A 11/2000 Kishita et al.
6,196,019 B1 * 3/2001 Higo ..... B60H 1/3229 62/474
6,318,116 B1 * 11/2001 Gabel ..... B60H 1/323 62/475
9,636,622 B2 * 5/2017 Yamasaki ..... B01D 53/0407
2001/0032478 A1 * 10/2001 McAllister ..... B01D 53/0415 62/509
2003/0079610 A1 * 5/2003 Hayes ..... B01D 53/0415 96/135
2006/0196223 A1 * 9/2006 Dexter ..... F25B 43/006 62/503
2007/0157658 A1 * 7/2007 Kiblawi ..... B01D 53/0431 62/474
2008/0041093 A1 * 2/2008 Sung ..... F25B 43/006 62/503
2014/0331713 A1 * 11/2014 Takeda ..... F25B 43/006 62/503
2015/0345844 A1 * 12/2015 Koster ..... F25B 31/004 62/512

FOREIGN PATENT DOCUMENTS

JP 2004-263995 A 9/2004
JP 2014-70869 A 4/2014
WO WO 2014038127 A1 * 3/2014 ..... F25B 43/006

* cited by examiner

ACCUMULATOR

RELATED APPLICATIONS

The present application claims priority from Japanese patent application JP 2015-143242 filed on Jul. 17, 2015, the content of which is hereby incorporated by reference into this application.

BACKGROUND OF THE INVENTION

1. Field of the Invention

The present invention relates to an accumulator (gas-liquid separator) used for a heat pump-type refrigerating cycle (hereinafter called a heat pump system), such as a car air-conditioner, a room air-conditioner, or a freezing machine.

2. Description of the Related Art

As illustrated in FIGS. 7A and 7B, a heat pump system 200 making up a car air-conditioner or the like typically includes a compressor 210, an outdoor heat exchanger 220, an indoor heat exchanger 230, an expansion valve 260, a four-way switching valve 240 and the like, as well as an accumulator 250.

In such a heat pump system 200, switching (channel switching) between cooling operation and heating operation is performed by the four-way switching valve 240. During cooling operation, refrigerant circulates in a cycle as shown in FIG. 7A, and at this time, the outdoor heat exchanger 220 functions as a condenser, while the indoor heat exchanger 230 functions as an evaporator. During heating operation, refrigerant circulates in a cycle as shown in FIG. 7B, and at this time, the outdoor heat exchanger 220 functions as an evaporator, while the indoor heat exchanger 230 functions as a condenser. For both types of the operation, refrigerant under low temperature and pressure and in a gas-liquid mixture state is introduced from the evaporator (the indoor heat exchanger 230 or the outdoor heat exchanger 220) to the accumulator 250 via the four-way switching valve 240.

For the accumulator 250, the structure as described in Patent Document 1, for example, is known, including a bottomed cylindrical tank having an upper opening thereof that is hermetically sealed with a lid member provided with an inflow port and an outflow port, a gas-liquid separating member having an outer diameter smaller than an inner diameter of the tank and having an umbrella-like or an inversed thin-bowl shape, an outflow pipe having a double-pipe structure, including an inner pipe having an upper end that is joined to the outflow port and hanging from there, and an outer pipe, a strainer disposed close to the bottom of (the outer pipe of) this outflow pipe to catch/remove foreign matters contained in liquid-phase refrigerant and oil (refrigerant oil) mixed therein, and the like.

Refrigerant introduced into this accumulator 250 collides with the gas-liquid separating member to be diffused radially and to be separated into liquid-phase refrigerant and gas-phase refrigerant. The liquid-phase refrigerant (including oil) flows down along the inner periphery of the tank and is accumulated at a lower part of the tank, and the gas-phase refrigerant descends through the space defined between the inner pipe and the outer pipe in the outflow pipe (gas-phase refrigerant descending channel) and then ascends through the space within the inner pipe to be sucked from the suction side of the compressor 210 for circulation.

Oil accumulated at the lower part of the tank together with the liquid-phase refrigerant moves toward the tank bottom because of a difference in specific weight, properties or the like from the liquid-phase refrigerant, is sucked by the gas-phase refrigerant that is sucked from the suction side of the compressor via the outflow pipe, and then passes through (a net filter of) the strainer→an oil returning port formed at the bottom of the outflow pipe (outer pipe)→the space within the inner pipe of the outflow pipe and is returned to the suction side of the compressor together with the gas-phase refrigerant for circulation (see Patent Documents 2, 3 as well).

Meanwhile, when the operation of the system (compressor) is stopped, liquid-phase refrigerant including oil is accumulated at the lower part of the tank of the accumulator. In this case, when the oil used is not compatible with the refrigerant and has specific weight smaller than that of the refrigerant, they are separated into two layers due to a difference in specific weight and viscosity between the liquid-phase refrigerant and the oil, i.e., the oil layer is formed above and the liquid-phase refrigerant layer is formed below.

In such a two-layered separation state, when the system (compressor) is started, then the pressure in the tank drops rapidly, and so the liquid-phase refrigerant boils suddenly and vigorously (hereinafter called bumping), which causes loud impact noise unfortunately.

Presumably such a bumping phenomenon and the following impact noise are generated because of the following reason. Such a bumping phenomenon can be suppressed till some point due to the presence of the oil layer serving as the lid of the refrigerant layer (no bumping phenomenon occurs at the oil layer) even when the pressure in the tank (suction side of the compressor) drops during the starting of the compressor. However, if a difference in pressure between the above of the oil layer (the gas-phase refrigerant) and the below (the liquid-phase refrigerant) becomes a predetermined value or more, the liquid-phase refrigerant boils at once and explosively, and therefore these phenomena will occur (see Patent Document 2 also, describing a bumping phenomenon in the compressor).

Alternatively, when oil and liquid-phase refrigerant are not in a two-layered separation state as stated above during stopping of the compressor, i.e., when the oil and the liquid-phase refrigerant are in a mixture state during stopping of the compressor as well, or also in the case where the oil used is not compatible with the refrigerant and has specific weight larger than that of the refrigerant, and the liquid-phase refrigerant layer is formed above and the oil layer is formed below, the aforementioned bumping phenomenon where the liquid-phase refrigerant boils at once and explosively and the following impact noise may occur depending on the conditions, such as types of the refrigerant and the oil, and their properties.

As a measure to suppress such a bumping phenomenon and the following impact noise, the above-mentioned Patent Document 2 proposes the technique of providing an agitation blade at the rotating shaft (crankshaft) of the compressor including a reciprocating engine as a driving source, and rotating the agitation blade for agitation of the oil-layer part during starting of the compressor so as to discharge the liquid-phase refrigerant to the above of the oil.

Patent Document 3 proposes the technique of, in order to mix the oil and the liquid-phase refrigerant in a two-layered separation state reliably in (the tank) of the accumulator as a main purpose, blowing a part of the gas-phase refrigerant discharged from the compressor into the liquid-phase refrigerant for agitation from the bottom of the tank via a bypass channel having an open/close valve.

3. Related Patent Documents

Patent Document 1: JP 2014-70869 A

Patent Document 2: JP 2001-248923 A

Patent Document 3: JP 2004-263995 A

SUMMARY OF THE INVENTION

As stated above, a liquid part of the oil and the liquid-phase refrigerant in the tank is agitated during the starting of the compressor, whereby a bumping phenomenon and the following impact noise can be suppressed, which can be confirmed by the present inventors or the like as well. According to the aforementioned conventionally proposed techniques, however, means for agitating, including an agitating blade, a driving source to rotate the blade, a bypass channel having an open/close valve and the like is required separately, which may lead to the problems that the structure of the accumulator (and a heat pump system including it) becomes complicated, or the cost and the size thereof increase.

In view of these circumstances, the present invention aims to provide an accumulator capable of effectively suppressing a bumping phenomenon and the following impact noise during the starting of the compressor without making the structure of the accumulator complicated or increasing the cost and the size thereof, and so having cost-effectiveness.

In order to fulfill the aim, an accumulator according to the present invention basically includes: a tank having an inflow port and an outflow port; and a double-pipe structured outflow pipe including an inner pipe joined to the outflow port and hanging inside of the tank, and an outer pipe disposed outside of the inner pipe, wherein a cloth-like member or a foam material is wound around or externally inserted to the outer pipe.

In a preferable embodiment, the cloth-like member or the foam material is wound around or externally inserted to at least a height area between a lower-limit liquid surface height position where abnormal sound is generated because of bumping of a liquid part including liquid-phase refrigerant and oil accumulated in the tank and a highest liquid surface height position of the liquid part.

In another preferable embodiment, the cloth-like member is provided with a desiccant storage part to store desiccant to absorb and remove water in refrigerant.

Preferably the desiccant storage part is disposed vertically and externally to the outer pipe.

Preferably the desiccant storage part is disposed externally to the outer pipe at a position closer to the inflow port.

In the accumulator of the present invention, the cloth-like member such as felt or the foam material (hereinafter called a cloth-like member or the like) wound around or externally inserted to the outer pipe serves as boiling stone. That is, the cloth-like member or the like (gas therein) can be an origination (trigger) for boiling of the liquid-phase refrigerant for vaporization during starting of the compressor, which leads to the state where air bubbles come out gradually, i.e., the liquid-phase refrigerant is gradually vaporized. Therefore boiling of the liquid-phase refrigerant proceeds gently and as a result a bumping phenomenon in which the liquid-phase refrigerant boils at once and explosively, and impact noise generated accordingly can be effectively suppressed.

In this case, the accumulator of the present invention includes a simple configuration added, like the cloth-like member or the like that is wound around or externally inserted to the outer pipe in the conventional accumulator, and therefore this has excellent cost-effectiveness without making the structure of the accumulator complicated or increasing the cost and the size thereof as in the conventional techniques as stated above.

Since the cloth-like member such as felt has air permeability and water permeability, the desiccant storage part to store desiccant therein to absorb and remove water in the refrigerant is disposed at the cloth-like member, such as felt, that is wound around or externally inserted to the outer pipe, whereby the desiccant storage part serves as a bag. Therefore there is no need to prepare a bag to store desiccant or its fixing means (e.g., banding band) separately, and so the cost-effectiveness can be improved more.

DETAILED DESCRIPTION OF THE PREFERRED EMBODIMENTS

The following describes embodiments of the present invention, with reference to the drawings.

[Embodiment 1]

Figure 1:
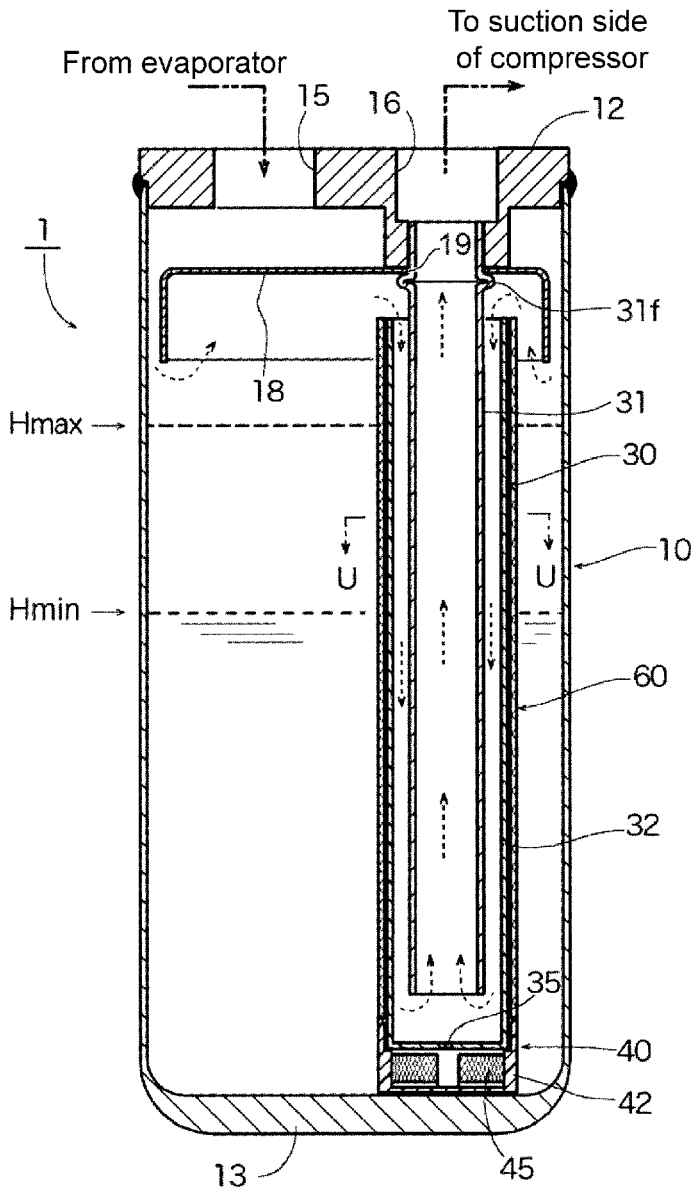
FIG. 1 is a partially cutaway front view showing Embodiment 1 of an accumulator according to the present invention.
Figure 2:
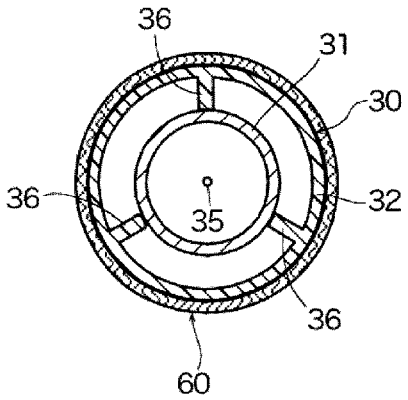
FIG. 2 is an enlarged cross-sectional view taken along the arrow U-U of FIG. 1.

FIG. 1 is a partially cutaway front view showing Embodiment 1 of an accumulator according to the present invention, and FIG. 2 is an enlarged cross-sectional view taken along the arrow U-U of FIG. 1.

Figure 7A:
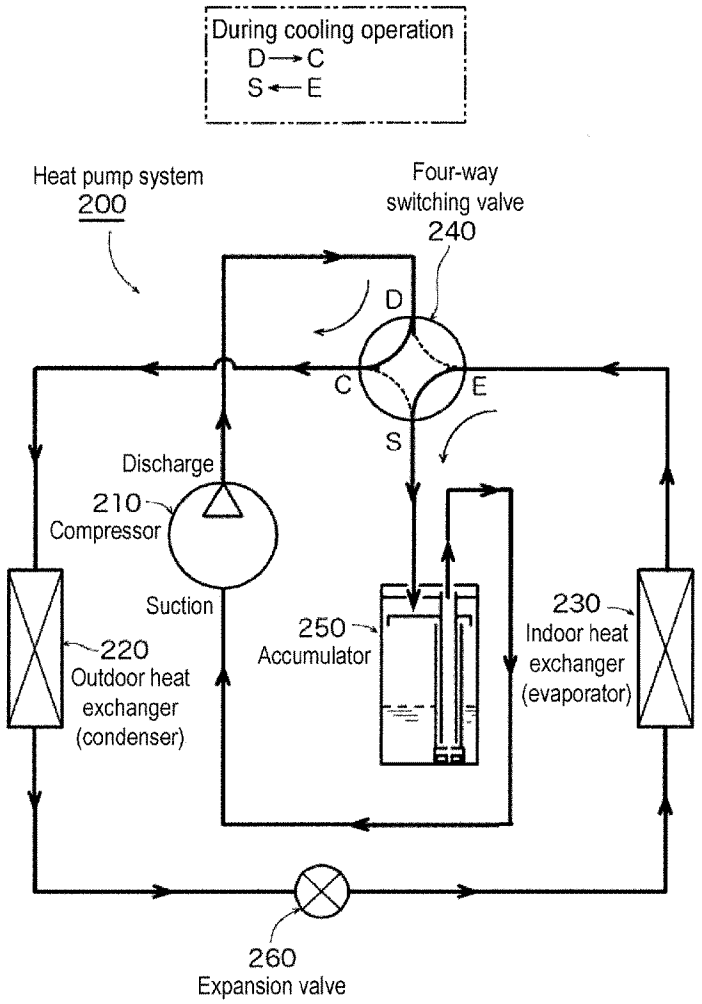
FIGS. 7A and 7B show one example of a heat pump system, where FIG. 7A schematically shows the configuration showing the flow (cycle) of refrigerant during cooling operation, and FIG. 7B schematically shows the configuration showing the flow (cycle) of refrigerant during heating operation.
Figure 7B:
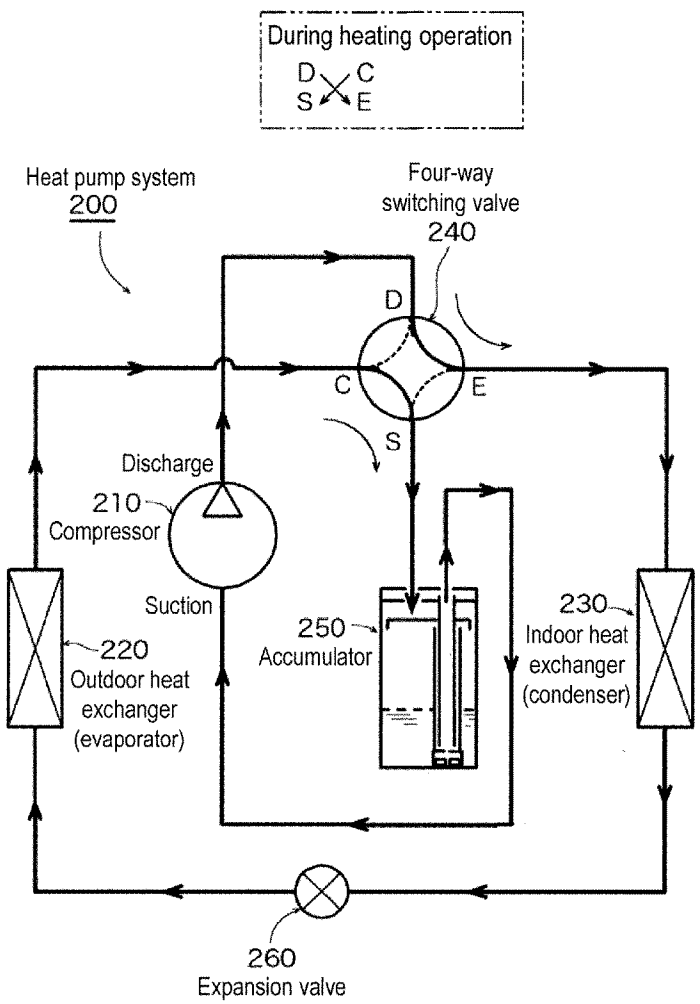

An accumulator 1 of Embodiment 1 in the drawing can be used as the accumulator 250 in the heat pump system 200 making up a car air-conditioner for electric vehicles, for example, as shown in FIGS. 7A and 7B as stated above, and includes a bottomed cylindrical tank 10 made of metal, such as stainless steel or aluminum alloy, where the upper opening of this tank 10 is hermetically sealed with a lid member 12 made of the same metal. Note here that the accumulator 1 of the present embodiment is installed vertically as illustrated, for example, i.e., the lid member 12 is located above (top) and a bottom 13 of the tank 10 is located below (bottom).

The lid member 12 has an inflow port 15 and a stepped outflow port 16 disposed side by side, a gas-liquid separating member 18 is disposed below the lid member 12, the gas-liquid separating member 18 having an outer diameter smaller than an inner diameter of the tank 10 and having an umbrella-like or an inversed thin-bowl shape, and an upper end of an outflow pipe 30 is jointed to the lower part of the outflow port 16.

The outflow pipe 30 has a double-pipe structure, including a metal inner pipe 31, the upper end of which is joined to the lower part of the outflow port 16 by swaging or press-fitting, for example, hanging inside of the tank 10 and a bottomed outer pipe 32 made of synthetic resin that is disposed around the inner pipe 31. As described below, a cloth-like member or the like is wound around or externally inserted to the outer pipe 32.

The lower end of the outer pipe 32 is internally fitted for fixing to an internally stepped upper part 42*a* of a case 42 of a strainer 40 described later by press fitting or the like. The lower end of the inner pipe 31 is located slightly above a bottom 32*b* of the outer pipe 32, and the upper end of the outer pipe 32 is located slightly below the lid member 12. At a center of the bottom 32*b* of the outer pipe 32, an oil returning hole 35 is formed. The oil returning hole 35 has a diameter of about 1 mm, for example.

Inside of the outer pipe 32, three rib plates 36 are disposed along the longitudinal direction (vertical direction) so as to protrude radially inwardly at equal angular intervals as shown in the cross-sectional view of FIG. 2, and the inner pipe 31 is internally inserted for fixing inside of these three rib plates 36 in a slightly press-fitting manner.

The inner pipe 31 is provided with a flange 31*f* at a part close to the upper end thereof, which is prepared by compressing and bending by bulge forming, for example. When the gas-liquid separating member 18 and the inner pipe 31 are assembled to the lid member 12, the upper end of the inner pipe 31 is allowed to pass through a hole 19 formed at the gas-liquid separating member 18, while press-fitting or performing expansion of the inner pipe for fixing to the outflow port 16 from the below. Thereby, the gas-liquid separating member 18 can be held and fixed so as to be sandwiched between the flange 31*f* and the lower-end face of the lid member 12.

Note here that the inner pipe 31, the outer pipe 32 and the rib plates 36 may be integrally formed by extrusion forming using a synthetic resin material, an aluminum material or the like. That is, the aforementioned double-pipe structure may be an integrally-formed product made of an aluminum extruded material, for example. The rib plates may be provided to the outer periphery of the inner pipe 31.

Figure 3:
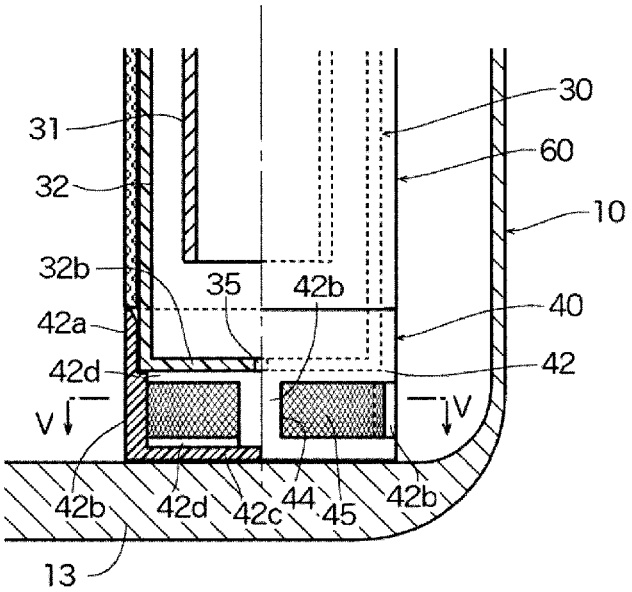
FIG. 3 is an enlarged half cross-sectional view showing the major part of the accumulator of Embodiment 1 around the strainer.
Figure 4:
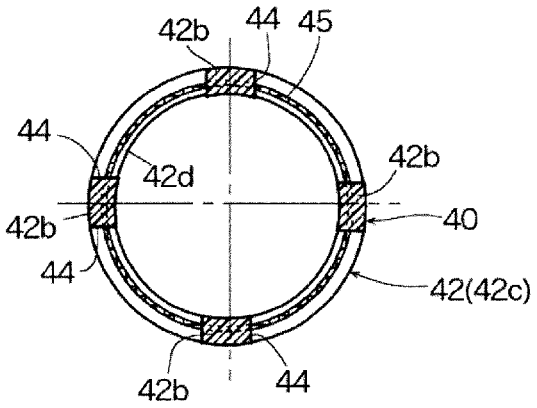
FIG. 4 is a cross-sectional view taken along the arrow V-V of FIG. 3.

The strainer 40 is placed on the bottom 13 of the tank 10 and is fixed there, and as understood from FIGS. 3 and 4, the strainer 40 includes the bottomed cylindrical case 42 made of synthetic resin and a cylindrical net filter 45 that is integral with the case 42 by insert molding. The net filter 45 may be prepared using metallic mesh or a mesh material made of synthetic resin, for example.

The case 42 of the strainer 40 includes: the internally stepped upper part 42*a* to which the lower end of the outer pipe 32 is internally fitted for fixing; a bottom-plate part 42*c;* four pillar parts 42*b* that are vertically disposed at equal angular intervals at the outer periphery of this bottom-plate part 42*c;* and annular belt-shaped mesh-end embedded parts 42*d,* 42*d* having predetermined thickness and belt width and including the upper ends and the lower ends of these pillar parts 42*b*. The upper and lower ends of the net filter 45 are integrated with these upper and lower mesh-end embedded parts 42*d,* 42*d* for sealing during insert molding, and a part of the net filter 45 corresponding to the pillar parts 42*b* also is integrated with the pillar parts 42*b* for sealing during insert molding. In other words, the four pillar parts 42*b* and the upper and lower mesh-end embedded parts 42*d,* 42*d* define four windows 44 having a rectangular shape in side view, and the net filter 45 is stretched over each of these windows 44. The four pillar parts 42*b* have an inclination for removal from a mold, but the four pillar parts 42*b* and the upper and lower mesh-end embedded parts 42*d,* 42*d* have a substantially same width in the radial direction.

In the thus configured accumulator 1, similarly to the conventional ones, refrigerant under low temperature and pressure and in a gas-liquid mixture state from the evaporator is introduced into the tank 10 through the inflow port 15, and the introduced refrigerant collides with the gas-liquid separating member 18 to be diffused radially and to be separated into liquid-phase refrigerant and gas-phase refrigerant. The liquid-phase refrigerant (including oil) flows down along the inner periphery of the tank 10 and is accumulated at a lower space of the tank 10, and the gas-phase refrigerant passes through the space (gas-phase refrigerant descending channel) defined between the inner pipe 31 and the outer pipe 32 in the outflow pipe 30→internal space of the inner pipe 31 and then is sucked from the suction side of the compressor 210 for circulation.

Oil accumulated at the lower space of the tank 10 together with the liquid-phase refrigerant moves toward the bottom 13 of the tank 10 because of a difference in specific weight, properties or the like from the liquid-phase refrigerant, is sucked by the gas-phase refrigerant that is sucked from the suction side of the compressor via the outflow pipe 30, and then passes through the net filter 45 of the strainer 40→the oil returning hole 35→the internal space of the inner pipe 31 and is returned to the suction side of the compressor together with the gas-phase refrigerant for circulation. When it passes through the net filter 45, foreign matters such as sludge are caught there, and the foreign matters are removed from the circulating refrigerant (including oil).

In addition to the configuration as stated above, the accumulator 1 of the present embodiment includes a cloth-like member 60, such as felt, that is wound around and externally inserted so as to cover the entire area of a part above the strainer 40 of the outer periphery of the outer pipe 32. Instead of the cloth-like member 60, a foam material may be used, and examples of the foam material include a member made of commercially available synthetic resin, rubber, ceramics or the like.

In the thus configured accumulator 1 of the present embodiment, the cloth-like member 60 wound around or externally inserted to the outer pipe 32 serves as boiling stone. That is, the cloth-like member 60 (gas therein) can be an origination (trigger) for boiling of the liquid-phase refrigerant for vaporization during starting of the compressor 210, which leads to the state where air bubbles come out gradually, i.e., the liquid-phase refrigerant is gradually vaporized. Therefore boiling of the liquid-phase refrigerant proceeds gently and as a result a bumping phenomenon in which the liquid-phase refrigerant boils at once and explosively, and impact noise generated accordingly can be effectively suppressed.

In this case, the accumulator 1 of the present embodiment includes a simple configuration added, like the cloth-like member 60 that is wound around or externally inserted to the outer pipe 32, and therefore this has excellent cost-effectiveness without making the structure of the accumulator complicated or increasing the cost and the size thereof as in the conventional techniques as stated above.

In the present embodiment, the cloth-like member 60 is provided so as to cover the entire area of a part above the strainer 40 of the outer periphery of the outer pipe 32 as stated above. In this respect, in order to suppress a bumping phenomenon and the following impact noise during the starting of the compressor 210, the cloth-like member 60 may be basically wound around or externally inserted to a height area between the lower-limit liquid surface height position Hmin where abnormal sound (impact noise) is generated because of bumping of the liquid part (liquid-phase refrigerant and oil) accumulated in the tank 10 during stopping of the compressor 210 and the highest liquid surface height position Hmax of the liquid part. These lower-limit liquid surface height position Hmin and highest liquid surface height position Hmax can be predetermined for the system at a position above the bottom 13 of the tank 10 by a predetermined height or at a position below from the upper end of the outer pipe 32 by a predetermined height.

[Embodiment 2]

Figure 5:
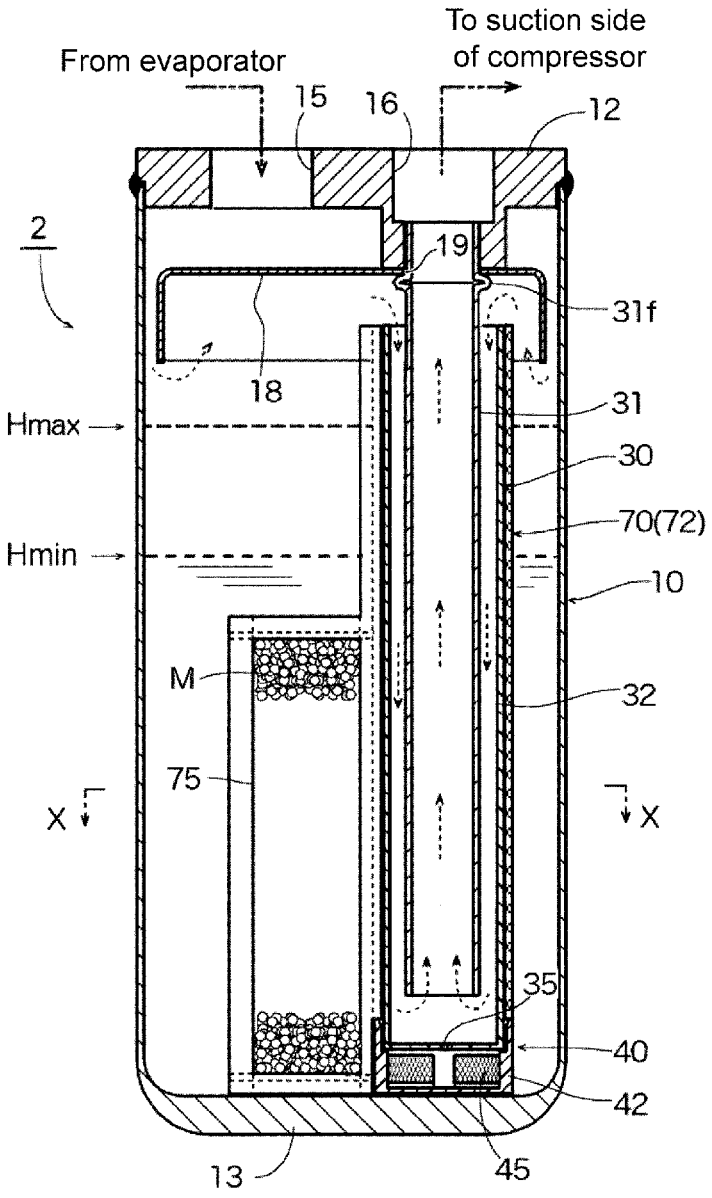
FIG. 5 is a partially cutaway front view showing Embodiment 2 of an accumulator according to the present invention.
Figure 6:
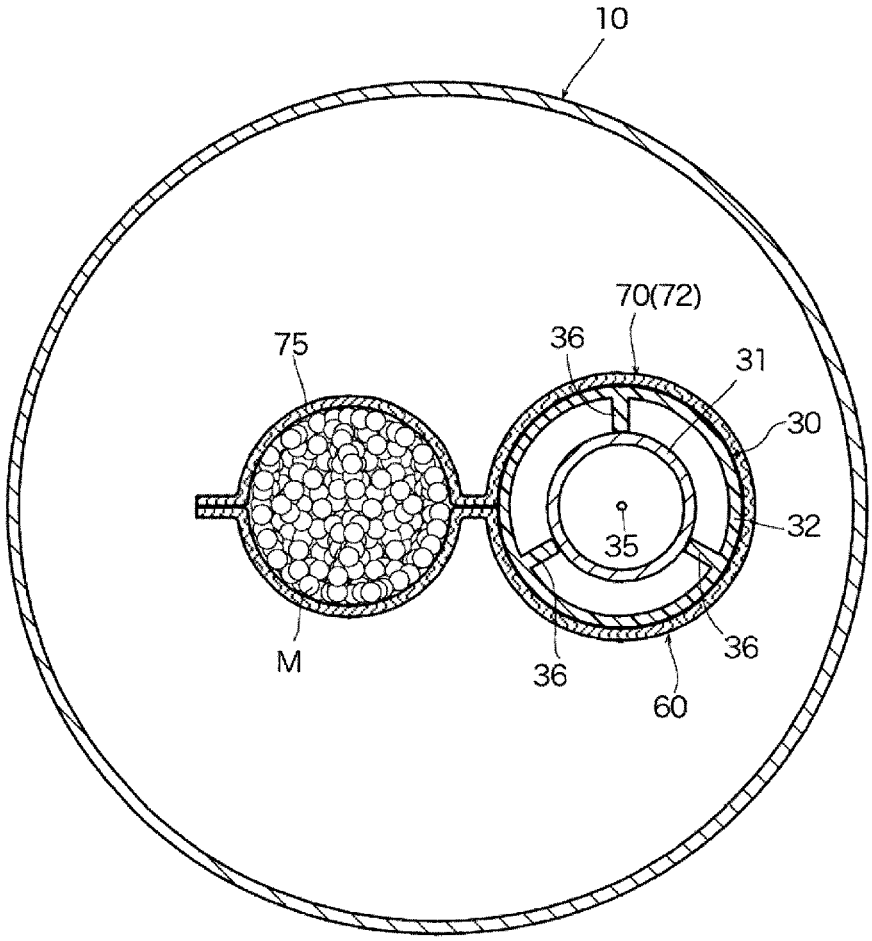
FIG. 6 is a cross-sectional view taken along the arrow X-X of FIG. 5.

FIG. 5 is a partially cutaway front view showing Embodiment 2 of an accumulator according to the present invention, and FIG. 6 is an enlarged cross-sectional view taken along the arrow X-X of FIG. 5.

An accumulator 2 of Embodiment 2 shown in the drawing is different from the accumulator 1 of Embodiment 1 in that a cloth-like member 70, such as felt, is provided with an externally-inserted part 72 that is externally inserted for fixing to the outer periphery of the outer pipe 32, and with a cylindrical desiccant storage part 75 whose top and bottom are blocked to store desiccant M to absorb and remove water in the refrigerant, and the configuration in the other respects is the same. In FIGS. 5 and 6 showing the accumulator 2 of Embodiment 2, the same reference numerals are assigned to the parts corresponding to those of the accumulator 1 of Embodiment 1.

The desiccant storage part 75 is disposed vertically (along the axial line of the outer pipe 32) and externally to the outer pipe 32 at a position closer to the inflow port 15.

Since the cloth-like member such as felt has air permeability and water permeability, the desiccant storage part 75 to store desiccant M therein to absorb and remove water in the refrigerant is disposed at the cloth-like member 70, such as felt, in addition to the externally-inserted part 72, whereby the desiccant storage part 75 serves as a bag. Therefore there is no need to prepare a bag to store desiccant M or its fixing means (e.g., banding band) separately, and so the cost-effectiveness can be improved more.

In the accumulator 2 of Embodiment 2 as stated above, the desiccant storage part 75 is disposed so that the lower end thereof comes into contact with the bottom 13 of the tank 10 and the upper end thereof is located below the highest liquid surface height position Hmax of the liquid part (liquid-phase refrigerant and oil) accumulated in the tank 10 during stopping of the compressor 210. In this respect, the desiccant storage part 75 may be extended above so that the upper part is located above the highest liquid surface height position Hmax. This configuration can suppress a bumping phenomenon and the following impact noise during starting of the compressor 210 more reliably.

What is claimed is:

1. An accumulator comprising:

a tank having an inflow port and an outflow port therein, the tank being configured to store a liquid inside including liquid-phase refrigerant and oil accumulated in the tank; and a double-pipe structured outflow pipe arranged in the tank, the double-pipe structured outflow pipe including an inner pipe joined to the outflow port and an outer pipe disposed radially outside of the inner pipe, the outer pipe having a length extended in axial direction inside the tank so that the outer pipe is at least partially submerge in the liquid stored in the tank, wherein a cloth-like member or a foam material is externally attached around the outer pipe along an entirety of the length of the outer pipe, the cloth-like member or the form material having an inner surface facing the outer pipe and an outer surface, opposite to the inner surface, being exposed to and in contact with the liquid-phase refrigerant stored in the tank, wherein the cloth-like member or the foam material functions to slow down vaporization of the liquid-phase refrigerant stored in the tank and prevent the liquid-phase refrigerant in the tank from explosively evaporating.

2. The accumulator according to claim 1, wherein the liquid stored in the tank has a phase therein at which bumping of the liquid is occurable, the phase being changeable in the tank within a range, and the outer pipe is extensive in the axial direction inside the tank so that the cloth-like member or the foam material externally attached around the outer pipe is axially extensive in the tank long enough to include the range within which the phase of the liquid is changeable in its height in the tank.

3. The accumulator according to claim 1, wherein the cloth-like member is provided with a desiccant storage part to store desiccant to absorb and remove water in refrigerant in the tank.

4. The accumulator according to claim 3, wherein the desiccant storage part is disposed vertically outside of the outer pipe.

5. The accumulator according to claim 3, wherein the desiccant storage part is disposed on a side of the outer pipe closer to a first imaginary line vertically extended in the tank from the inflow port than a second imaginary line vertically extended in the tank from the outflow port.

* * * * *